United States Patent [19]

Truax et al.

[11] 3,963,157

[45] June 15, 1976

[54] BALL BELT

[76] Inventors: Nancy Rosbottom Truax, 6708 Glenhurst St., Dallas, Tex. 75240; Margaret Ann Rosbottom, 731 Pierremont Road, Shreveport, La. 71106

[22] Filed: Sept. 25, 1974

[21] Appl. No.: 509,104

[52] U.S. Cl. ..... 224/5 D; 2/319; 224/26 R

[51] Int. Cl.[2] ..... A45C 11/00

[58] Field of Search ..... 224/5 D, 5 C, 5 A, 5 MC, 224/5 L, 5 H, 5 R, 5 E, 26 B, 26 R, 13, 21, 22, 23, 3, 26 D; 2/319, 311; 211/14, 15

[56] References Cited

UNITED STATES PATENTS

| | | | |
|---|---|---|---|
| 1,911,256 | 5/1933 | Andrew | 224/5 D |
| 2,548,330 | 4/1951 | Wiseman | 224/5 D |
| 2,558,382 | 6/1951 | Previdi | 224/5 C |
| 2,708,061 | 5/1955 | Kotchka | 224/5 D |
| 3,148,812 | 9/1964 | Hilsinger, Jr. | 224/5 R |

FOREIGN PATENTS OR APPLICATIONS

| | | | |
|---|---|---|---|
| 300,428 | 11/1928 | United Kingdom | 224/5 C |

*Primary Examiner*—M. H. Wood, Jr.
*Assistant Examiner*—David M. Mitchell

[57] ABSTRACT

The invention relates in general to holding several light weight balls around the waist or hips; and more particularly to holding several light weight balls around the waist one separately and securely held from the other.

1 Claim, 4 Drawing Figures

BALL BELT

The object of the invention is to hold several light weight balls in a fixed position around the waist securely so that a person may run, jump, bend or sit without jarring the balls from their fixed position.

The object of the invention is to allow a person to place balls around the waist and remove them as desired. The object of the invention is to allow a person to separate the waist supporter 1 from the holder 2 for the purpose of adding or subtracting the number of holders from the waist supporter.

Figure 1:
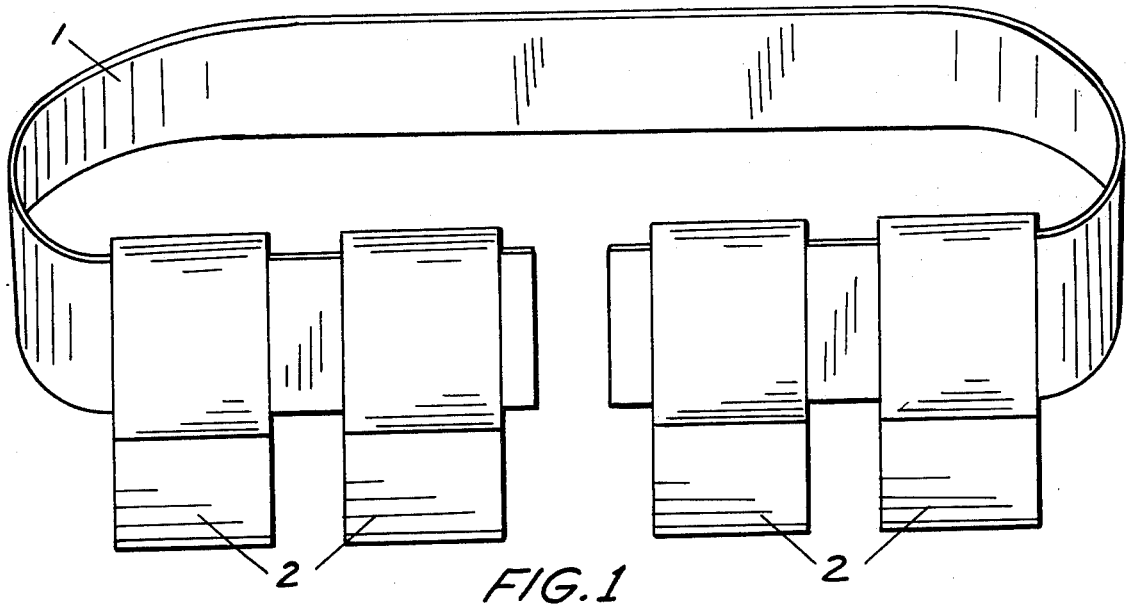

Other objects and a fuller understanding of the invention may be had be referring to the following description and claims, taken in conjunction with the accompanying drawings in which:

FIG. 1 shows a frontal view of the invention, a length of waist supporter 1 which supports removable holders 2 (four are illustrated)

Figure 2A:
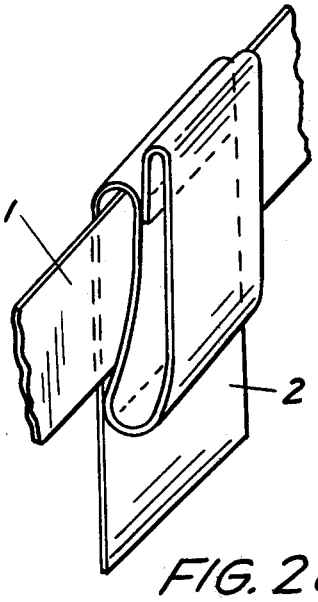

FIG. 2*a* shows a three quarter view of one of the holders on the waist supporter demonstrating the folding and sewing procedure.

Figure 2B:
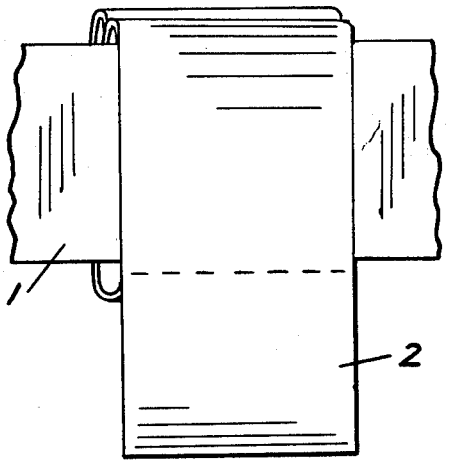

FIG 2*b* shows a back view of one of the holders on the waist supporter demonstrating the sewing procedure.

Figure 2C:
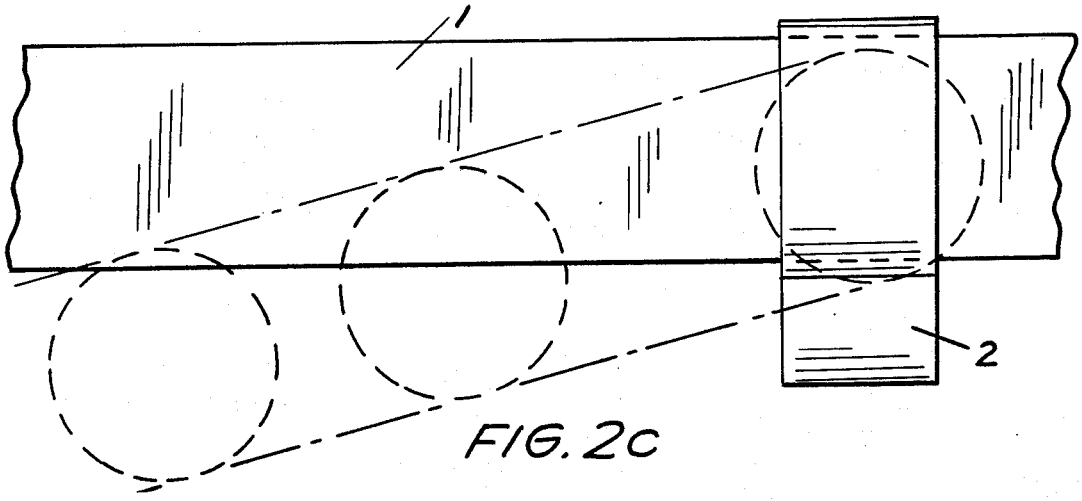

FIG. 2*c* shows a frontal view of one of the holders on the waist supporter with an exploding view suggesting how a ball may be placed into and removed from the invention.

With reference to the drawing, the invention compromises a fairly wide piece of fabric cut into various waist lengths 1 on which detachable fabric holders 2 are supported. The invention is completed by attaching any style fastener to each end of the waist supporter. The invention is worn around the waist or hips. The holder may be slipped onto and off of the waist supporter. As many holders as desired may be supported in any position desired.

The fabric used to make the invention is a stretch fabric which gives support and comfort yet stability and holding power. The fabric will stretch as the ball is placed into the holder then retract to grasp the ball tightly. Decorative items may be placed in any position as desired.

To construct the invention, cut a piece of any width elastic stretch fabric and fold as illustrated in 2*a*. Sew the fabric as illustrated in 2*a* & 2*b*. After sewing you will have a piece of fabric with two loops: one holds the ball; the other slides onto the length of waist supporter 1 and can extend below the waist supporter forming an end onto which any form of decoration may be placed.

The invention is used when playing any game in which several balls are utilized consecutively, and or for holding balls for any purpose desired. By having easy access to the balls around the waist, the person is ready to utilize several balls quickly and consecutively. The actual date of reduction to practice was Dec. 13, 1972. Work began on the model Feb. 1, 1973.

Although was have described the invention with a certain degree of particularity, it is understood that the present disclosure has been made only by way of example and that numerous changes in the details of construction and the combination and arrangement of parts may be restored to without departing from the spirit and the scope of the invention as herein claimed:

We claim as our invention:

1. A ball belt to be worn around a users's waist or hips comprising:

a. a length of stretch fabric forming a waist encircling supporter band;

b. at least one holder having two flat loops of stretch fabric, said loops each forming adjacent, double openings having essentially parallel axes, one of said openings removably and adjustably receiving said supporter band, and the other of said openings resiliently and selectively receiving and supporting a ball.

* * * * *